United States Patent [19]

McAllister et al.

[11] 4,155,358

[45] May 22, 1979

[54] RESPIRATOR

[75] Inventors: Jerome W. McAllister, St. Paul; James A. Ord, Jr., Blaine; Leon W. Anders, Woodbury; Gunter A. Kohler, Grant Township, Washington County, all of Minn.

[73] Assignee: Minnesota Mining and Manufacturing Company, St. Paul, Minn.

[21] Appl. No.: 750,266

[22] Filed: Dec. 13, 1976

[51] Int. Cl.[2] ..... A62B 7/10

[52] U.S. Cl. ..... 128/146.6; 128/146.3; 128/142.6; 55/274; 252/408

[58] Field of Search ..... 128/146.6, 142.6, 142 R, 128/147, 191 R, 188, 146.2, 146.5; 252/408; 55/274, DIG. 33, DIG. 34, DIG. 35

[56] References Cited

U.S. PATENT DOCUMENTS

| | | | |
|---|---|---|---|
| 1,789,262 | 1/1931 | Monro et al. | 55/DIG. 35 |
| 2,665,686 | 1/1954 | Wood et al. | 128/146.6 X |
| 3,615,233 | 10/1971 | Doering | 128/191 R |
| 3,902,485 | 9/1975 | Wallace | 128/142.6 |
| 3,966,440 | 6/1976 | Roberts | 55/274 |

*Primary Examiner*—Henry J. Recla

*Attorney, Agent, or Firm*—Cruzan Alexander; Donald M. Sell; Edward T. Okubo

[57] ABSTRACT

A disposable valveless chemical cartridge respirator for filtration of vinyl chloride monomer having an end of service life indicator is disclosed.

6 Claims, 2 Drawing Figures

RESPIRATOR

BACKGROUND OF THE INVENTION

The present invention relates to valveless chemical cartridge respirators for filtration of vinyl chloride monomer (VCM) and having an end of service life indicator as an integral part thereof. So far as is known, all commercially available chemical cartridge respirators are equipped with inhalation and exhalation valves. Inhalation valves prevent exhaled air from entering the cartridge and contaminating the filter media with excess humidity. Exhalation valves permit easier exhalation since the resistance to flow of air therethrough is very low.

The prior art, including various governmental agencies, has treated as inviolable fact that respirators for toxic vapors and gases must be equipped with inhalation and exhalation valves to be effective. Thus, reference to Subpart L of Part 11 of Subchapter B of Chapter 1, Title 30, Code of Federal Regulations, Federal Register, Vol. 37, No. 59, March 25, 1972, and Subpart N, Federal Register, Vol. 39, No. 251, Dec. 30, 1974, (hereafter to be referred to as 30 CFR Part 11, Subpart and Section) will comfirm the fact that approval of chemical cartridge respirators is predicated on structures containing inhalation and exhalation valves. The Australian Standards CZ11 and Z18—1968 for "Respiratory Protective Devices" and British Standard BS 2091: 1969 for "Respirators for Protection Against Harmful Dusts and Gases" are similarly premised.

SUMMARY OF THE INVENTION

The present invention relates to long-life valveless chemical cartridge respirators for vinyl chloride monomer and is intended for uses where approval by the Mining Enforcement and Safety Administration or the National Institute of Occupational Safety and Health (NIOSH) would be required.

It was early recognized that any respirator for vinyl chloride monomer would require approval from the pertinent regulatory agency in order to be a viable commercial product. The requirements for NIOSH approval of a vinyl chloride respirator are found in 30 CFR Part 11, Subpart N, Sections 11-200 through 11-208. Under these regulations, a vinyl chloride respirator must last at least 120 minutes before 1 ppm VCM penetrates the cartridge. Accordingly, although considerable effort was expended in attempts to meet the applicable standards for cartridge type respirators by using a wide variety of commercially available carbons in a test cartridge with dimensions approximating a chemical cartridge for a respirator, no carbon was found which lasted more than 70 minutes when tested under the conditions prescribed in Subpart N, Section 11-203. Other efforts were directed to different media formulations and cartridge configurations.

It was then discovered that by the seemingly simple expedient of eliminating the inhalation and exhalation valves of the known prior art chemical cartridge respirators, low pressure-drop valveless filter-type respirators having breakthrough times to toxic vapors and gases at least double the breakthrough times of conventional valved respirators utilizing identical chemical cartridges were obtained. Additionally, it was found that, depending on the type of carbon utilized, the amount of filter media in the respirator could be reduced to about 50% or less of the previously "required" amount thus making it possible to greatly reduce the size and weight of the chemical cartridge, resulting in a lighter and more comfortable respirator.

There still remained the necessity of providing an end of service life indicator in order for the respirator to qualify for approval under the above noted governmental standards. An extremely reliable yet exceedingly simple end of service life indicator which undergoes a dramatic and distinct color change has now been discovered.

BRIEF DESCRIPTION OF THE DRAWINGS

In the accompanying drawing which illustrates the invention.

DETAILED DESCRIPTION OF THE INVENTION

Figure 1:
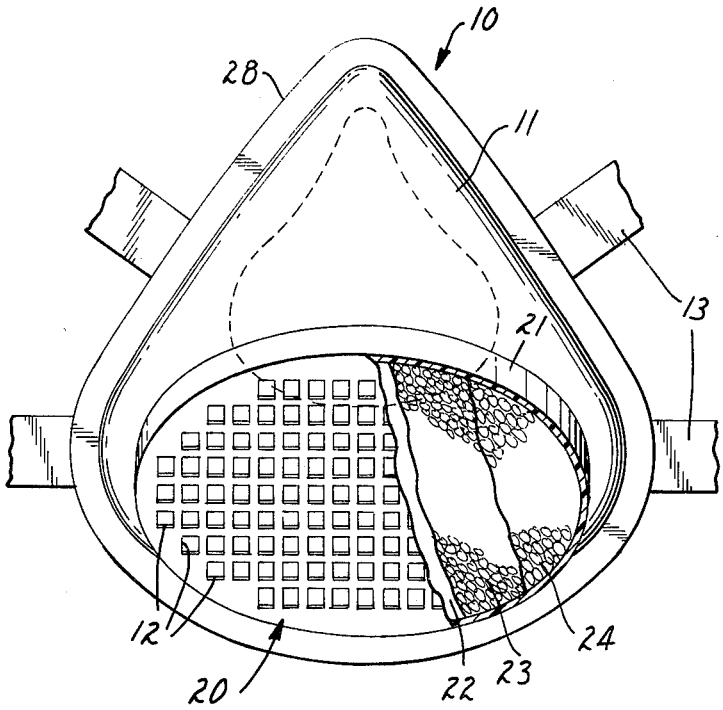
FIG. 1 is a front elevational view of a chemical cartridge respirator embodying the principles of the present invention.
Figure 2:
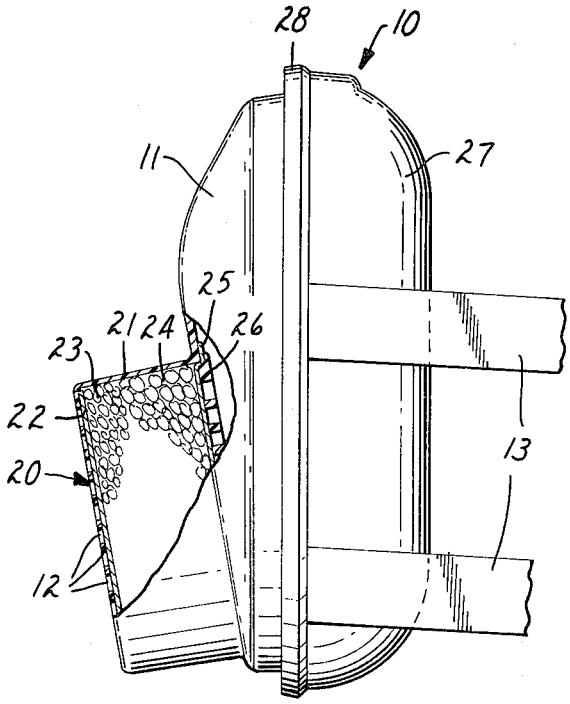
FIG. 2 is an enlarged view, partly in section, of the respirator of FIG. 1.

Referring more particularly to FIG. 1 of the drawing, 10 denotes a valveless cartridge respirator comprising a transparent molded plastic body 11 of a generally pear-shaped contour and having an inwardly turned marginal lip or edge portion to provide an air-tight seal. Chemical cartridge 20 is formed as an integral part of body 11 and comprises a shallow, generally cylindroid molded transparent plastic container 21 provided with openings 12 to form a mesh for air passage. Cartridge 20 has a volume of about 220 cc. for the indicator and filter media (sorbent). Starting from the front or left as viewed in FIG. 2, the cartridge 20 contains a nonwoven retainer web 22, 30 cc. of indicator 23, 190 cc. of activated carbon 24 and a second nonwoven retainer web 25. A molded mesh plate 26 is welded to the back of cartridge 20 to hold the contents tightly in place. A molded, polymeric facepiece 27 and suitable headbands 13 are laid in place inside a crimping lip 28 forming the periphery at body 11. The lip is heated, crimped, and upon cooling tightly holds the facepiece 27 and bands 13 in place. The respirator 10 may, if desired, be equipped with a speaking diaphragm (not shown).

The indicator of the present invention comprises specially prepared activated alumina granules coated first from a 1% solution of $KMnO_4$, which is then reduced to what is believed to be $MnO_2$, and then coated from a 0.55% solution of potassium permanganate. The indicator is viewed through the side wall of the cartridge all along the edge nearest the entrance to the cartridge. The initial color is a light purple or purple-pink, hereinafter referred to as purple for simplicity. Upon exposure to vinyl chloride, the potassium permanganate is reduced to manganese dioxide such that there is a slow, continuous color change from the purple to a light brown or tan-beige (hereafter referred to as brown), the color of manganese dioxide.

The indicator of the present invention is prepared by first coating alumina granules with potassium permanganate which is then reduced to the brown manganese dioxide which acts as a partial screen and color enhancer for the final coating of potassium permanganate. The brown $MnO_2$ coating on the granules acts as a color screen to hide some of the purple of the $KMnO_4$. The more brown $MnO_2$ present, the more purple $KMnO_4$ is covered up. Thus, for any given indicator life (modified NIOSH VCM test conditions), say 260 minutes, one must adjust the $KMnO_4$ coating concentration for a given $MnO_2$ coating concentration so that the indicator is visually brown at the end of the period. For any $MnO_2$ concentration (greater than zero), there will be some residual purple $KMnO_4$ left on the indicator granule at the end of the indicator life but it will be visually screened out by the brown $MnO_2$. This is illustrated by the fact that an indicator sample coated from a 1% manganese dioxide solution and a 0.55% potassium permanganate solution results in an indicator life of 256 minutes, about the same life as the indicator coated from 0% manganese dioxide and a 0.1% $KMnO_4$ solution. The 0% $MnO_2$—0.1% $KMnO_4$ indicator is very light pink in color and changes only slightly to a light cream color when spent. On the other hand, the 1% $MnO_2$—0.55% $KMnO_4$ indicator changes quite dramatically from the starting purple to the endpoint brown color. The color contrast from start to finish for the latter is much greater and thereby makes the indicator much easier for the user to read. The following table shows several indicator samples:

| $MnO_2$ solution concentration | $KMnO_4$ solution concentration | % $KMnO_4$ on granule (by weight) | Indicator life (minutes) |
|---|---|---|---|
| 0% | 0.1% | 0.036 | 257 |
| 1.0% | 0.35% | 0.134 | 220 |
| 1.0% | 0.55% | 0.228 | 256 |
| 1.0% | 0.70% | 0.352 | 330 |
| 1.25% | 0.55% | 0.231 | 180 |
| 1.25% | 0.80% | 0.476 | 333 |

The indicator is made by preparing a solution of known concentration of potassium permanganate in water. Activated alumina granules in a size range of 8 to 14 mesh, available from Reynolds Chemical Products, is immersed in the solution until the solution has absorbed onto the alumina granules to its equilibrium level. Excess solution is drained off and the granules are dried at about 230° F. under vacuum with rotation. The coated granules are heated to about 500° F. at atmospheric pressure for a period of time necessary to reduce the potassium permanganate to manganese dioxide. A second solution of known concentration of potassium permanganate in water is prepared. The manganese dioxide coated alumina granules are immersed in the solution until the absorption reaches an equilibrium level. The excess solution is drained off and the granules are again dried at about 230° F. under vacuum with rotation.

As noted hereinabove, prior workers in the chemical cartridge type respirator art have considered inhalation and exhalation valves to be essential for proper respirator functioning. Inhalation valves were thought to be necessary to avoid contaminating the filter media with excessive humidity, since it was "known" that the adsorption capacity of the filter media was detrimentally affected by high humidity, especially relative humidities above 50%. Exhalation valves were, of course, necessary to enable respiration to take place since one could not exhale through the filter media with the inhalation valve in place. In addition, the exhalation valves were designed such that the resistance to flow of air therethrough was very low.

It has now been discovered that any deleterious effect on the filter media caused by the high humidity of exhaled air is more than offset by the apparent desorption of the contaminant from the filter media, such that the breakthrough time of the filter media in a valveless respirator is at least doubled over a conventional valved respirator. Because of this increased efficiency of the filter media it is possible to greatly decrease the quantity of filter media and thereby achieve sufficiently low resistance to flow of air in the exhalation cycle to obviate the need for a separate exhalation valve. Since respiration takes place through the filter media during the inhalation and exhalation cycles in the respirator of the present invention, the low pressure drop is also experienced on inhalation, resulting in a truly comfortable lightweight respirator.

The respirator of the present invention in the embodiment shown in the drawings is totally disposable. An important advantage realized by a disposable respirator resides in the fact that it can be discarded after use thereby avoiding the rigorous maintenance program for respirators dictated by the governmental regulations pertaining to worker safety (See for example, 30 CFR Part 11, Subpart A, Section 11.2-1 and 29 CFR Part 1910, Subpart I, Section 1910.134).

It is to be understood that although the present invention is mainly described in terms of disposable chemical cartridge respirators, other forms of respirators are contemplated as coming within the scope of the present invention.

Breakthrough tests were conducted on identical respirators, utilizing a Mechanical Breathing Machine constructed according to specifications set forth in *A.M.A. Archives of Industrial Health,* Vol. 13, pp. 561-566, 1956. The tests set forth in 30 CFR Part 11 were modified as described below to permit testing of the respirators first in the conventional manner (when exhalation bypasses the chemical cartridge) and second, according to the present invention where exhalation is accomplished through the chemical cartridge.

A bench test for chemical cartridge respirators for vinyl chloride monomer is set forth in 30 CFR Part 11, Subpart N, Section 11.200-8. It states that an equilibration atmosphere of 85±5% relative humidity and 25°±5° C. will enter the cartridge continuously at 25 lpm for 6 hours. Next, a test atmosphere of 85±5% relative humidity and 25°±5° C. will enter the cartridge continuously at 64 lpm and 10 ppm of VCM and that, to merit approval, the cartridge should have a minimum life of 120 minutes to the penetration of 1 ppm of VCM.

The bench test for single use dust respirators set forth in 30 CFR part 11, Subpart K, Section 11.140-5 states that 40 liters of air per minute will be cycled through the respirator by a breathing machine at the rate of 24 respirations per minute, using a cam having a work rate of 622 kg.-$m^2$/minute. Air exhaled through the respirator is required to be at 35°±2° C. (95±3° F.) and 94±3% relative humidity.

Since the valveless, chemical cartridge type organic vapor respirator of the present invention depends upon desorption of the contaminant from the filter media during exhalation to extend its lifetime over that of a conventional valved respirator, meaningful bench testing can be accomplished only by cycling airflow with a breathing machine. The bench test consists essentially of a combination of the two bench tests described above, i.e., cycling the VCM atmosphere described in 30 CFR Part 11, Subpart N, Section 11.200-8 through the respirator by means of the breathing machine described in 30 CFR Part 11, Subpart K, Section 11.140-5. The minimum life of the cartridge is the number of minutes measured to the detection of 1 ppm VCM penetration. Since the breathing machine airflow volume is 40 lpm rather than 64 lpm, the minimum acceptable life for the cartridge was calculated to be: (64/40)×(120 minutes) or 192 minutes.

In the test, a respirator is mounted in a large chamber through which a large volume of 25° C. air containing 10 ppm VCM at 85% relative humidity is continuously added and exhausted. A rubber hose was used to provide an airtight seal between the respirator cartridge mounting device and the breathing machine. A Process Analyzer Incorporated Total Hydrocarbon Analyzer removes 90 cc./min. from the inhalation air and continuously measures the VCM concentration; the analyzer is calibrated for VCM and has a minimum sensitivity of 0.1 ppm. At various intervals the same analyzer is used to measure the chamber concentration to insure that the 10 ppm VCM challenge is maintained.

The test atmosphere is produced by flowing a measured amount of vinyl chloride gas into the airflow. The 85% relative humidity is maintained by flowing dry air through a container of heated water.

The temperature and humidity of the exhaled air are continuously monitored with a wet bulb - dry bulb hydrometer to insure 95°±3° F. and 94±3% relative humidity. This temperature and humidity are generated by passing the exhaled air through a long heated glass tube into which water is added at a constant rate. The temperature and humidity are controlled by varying the temperature of the tube walls and by varying the water addition rate.

When testing the respirator in the conventional valved manner (where exhalation bypasses the chemical cartridge), the exhaled air from the breathing machine is vented to the atmosphere.

Following the above described modified NIOSH VCM certification test with the breathing machine substituted, the respirator demonstrates a service life of 295 minutes, which greatly exceeds the minimum acceptable life (corrected time) of 192 minutes. The 295 minutes service life corresponds to a comparable valved service life of 30 minutes. Under the modified NIOSH (breathing machine) conditions, indicator color change is complete at 256 minutes for the 1% $MnO_2$−0.55% $KMnO_4$ indicator. Complete color change means there is no visually perceptible purple remaining in the indicator bed. It is believed that an indicator life of approximately 90% of service life, which is within the NIOSH required 80±10%, is especially reasonable and realistic since a user does not normally subject a respirator to water vapor equilibration prior to usage but rather uses the respirator in the "as received" condition. A respirator, tested according to the NIOSH VCM certification test with a breathing machine substituted and, without prior water vapor equilibration, was found to have its 1 ppm service life extended to 480 minutes while the indicator showed a complete color change at 232 minutes. This is an indicator life of approximately 50% of service life.

It will be noted that the indicator of the present invention is an intrinsic part of the sorbent bed. It samples a true cross-section of the atmosphere experienced by the sorbent bed. It is not a small window on the side of an opaque canister which tells the user when a given concentration has reached the sorbent depth where the window is located. This window approach is the one taken by the patentee of U.S. Pat. No. 3,966,440.

It will also be noted that the indicator is located at the entrance of the sorbent bed rather than at the exit. An indicator located at the entrance of the sorbent bed is exposed to the test atmosphere (10 ppm of vinyl chloride) for the entire time interval of the test.

On the other hand, if the indicator is at the exit, it is exposed only to that amount of VCM which has penetrated the sorbent bed. Tests have shown that the coating weight of $KMnO_4$ on the indicator granules must be varied depending on the amount of VCM expected to be experienced during testing. This is confirmed by the fact that an entrance located 0% $MnO_2$−0.1% $KMnO_4$ indicator changes color completely in 257 minutes in the equilibrated NIOSH tests whereas an identical indicator in an exit location changes color completely in 620 minutes. This is, of course, long after the respirator has failed. Since an exit located indicator is exposed to only about 1/20 the amount of VCM as an entrance located indicator over a 257 minute test period, decreasing the $KMnO_4$ coating weight to the level where color change would be expected to be complete in 257 minutes, i.e., 0% $MnO_2$−0.02% $KMnO_4$ or lower, results in an indicator having no visually perceptible color.

An added advantage realized in an entrance located indicator is that it samples only the vapor in the inhaled air. Potassium permanganate on alumina oxidizes most organic vapors. The exhaled breath contains many organic vapors, particularly after the user has ingested an organic chemical. An entrance-located indicator is protected from chemicals in the breath by the carbon sorbent bed.

What is claimed is:

1. A disposable valveless chemical cartridge respirator for filtration of vinyl chloride monomer comprising a body including a facepiece having means for peripherally sealing contact with at least that portion of a human head which includes the nose and mouth, associated fastening means for holding said respirator in position on the head, a cartridge on said body having an air entrance and an air exit communicating with the interior of said respirator and containing therewithin filter media comprising activated carbon and an end of service life indicator said cartridge having a volume of about 220 cc. for said indicator and said filter media, said indicator being disposed across the path of air intake at the entrance of said cartridge, said filter media and indicator being adapted for adsorption thereon of a vinyl chloride monomer contaminant upon inhalation therethrough, said indicator including means upon exposure to a predetermined amount of vinyl chloride monomer undergoing a dramatic and distinct color change to indicate the end of service life of said respirator.

2. A disposable valveless chemical cartridge respirator according to claim 1 wherein said indicator comprises activated alumina granules in a size range of 8 to 14 mesh coated with potassium permanganate, said color change being from pink to light cream.

3. A disposable valveless chemical cartridge respirator according to claim 1 wherein said indicator comprises activated alumina granules having a first color enhancing coat of manganese dioxide overcoated with a second color coat of potassium permanganate, said color coat of said indicator upon exposure to a predetermined amount of vinyl chloride monomer being reduced to manganese dioxide such that there is a slow, continuous color change from purple to brown to indicate the end of service life of said respirator.

4. A disposable valveless chemical cartridge respirator according to claim 3 wherein said filter media and indicator are contained in a cartridge integrally formed as a part of the respirator body.

5. A disposable valveless chemical cartridge respirator according to claim 4 containing about 190 cc. of activated carbon and about 30 cc. of indicator granules, said respirator upon exposure to an atmosphere containing 10 parts per million of vinyl chloride gas having a breakthrough time to one part per million of vinyl chloride gas of about 295 minutes and an end of service life indicator color change time of about 256 minutes.

6. A disposable valveless chemical cartridge respirator according to claim 4 wherein said indicator granules are disposed in a layer located at the entrance of said cartridge.

* * * * *